US011684138B1

(12) United States Patent
Yan et al.

(10) Patent No.: US 11,684,138 B1
(45) Date of Patent: Jun. 27, 2023

(54) CONTAINER FOR A STICK PRODUCT

(71) Applicant: ELC Management LLC, Melville, NY (US)

(72) Inventors: Jian Yan, Kirkland (CA); Michael Lyons, Redding, CT (US); Chad Garrison, Port Jefferson, NY (US)

(73) Assignee: ELC Management LLC, Melvile, NY (US)

( * ) Notice: Subject to any disclaimer, the term of this patent is extended or adjusted under 35 U.S.C. 154(b) by 0 days.

(21) Appl. No.: 17/731,425

(22) Filed: Apr. 28, 2022

(51) Int. Cl.

| | |
|---|---|
| ***A45D 40/06*** | (2006.01) |
| ***A45D 40/04*** | (2006.01) |
| ***A45D 40/00*** | (2006.01) |
| ***A45D 40/20*** | (2006.01) |

(52) U.S. Cl.
CPC ..... *A45D 40/06* (2013.01); *A45D 40/04* (2013.01); *A45D 2040/0025* (2013.01); *A45D 2040/208* (2013.01)

(58) Field of Classification Search
CPC ..... A45D 40/00; A45D 40/06; A45D 40/065; A45D 40/20; A45D 40/02; A45D 40/04; A45D 40/023; A45D 40/205; A45D 2040/208
USPC ..... 401/75–78, 171–175
See application file for complete search history.

(56) References Cited

U.S. PATENT DOCUMENTS

| | | | | |
|---|---|---|---|---|
| 5,649,777 | A * | 7/1997 | Holloway | A45D 40/16 401/74 |
| 11,311,092 | B1 * | 4/2022 | Yan | A45D 40/12 |
| 11,553,778 | B2 * | 1/2023 | Trochel | A45D 40/16 |
| 2007/0217857 | A1 * | 9/2007 | Ho | A45D 40/06 401/78 |

* cited by examiner

*Primary Examiner* — David J Walczak
(74) *Attorney, Agent, or Firm* — Peter Giancana

(57) ABSTRACT

A container for a stick product utilizes a novel inner body that has no gaps along its top perimeter. As a result, significant advantages in assembly and operation are realized. Containers according to the present invention may be useful for all types of stick products that are applied by drawing the product across a surface.

9 Claims, 14 Drawing Sheets

CONTAINER FOR A STICK PRODUCT

FIELD OF THE INVENTION

The present invention relates to improvements for a container that houses a stick product. More particularly, the invention relates to a container that enables a stick product in a holder cup to be moved between an extended position, where the product within the holder cup is capable of being applied by a consumer, and a retracted position. The invention also relates to methods of assembling such a container.

BACKGROUND OF THE INVENTION

A well known type of container for a stick product features a base that is connected to a cylindrical inner body, and a cam sleeve that is placed around the inner body, such that the cam sleeve and inner body can rotate with respect to each other. The inner body is hollow, and has a wall with at least one longitudinal slot that extends through the wall. The cam sleeve has an inner wall that features at least one helical groove that extends along a substantial length of the inner wall. A holder cup for a stick product is provided, and comprises at least one cam follower in the form of a lug. When the holder cup is fitted into the inner body, the lug extends through the longitudinal slot of the inner body to engage the helical groove of the cam sleeve. In this arrangement, when the inner body is rotated relative to the cam sleeve, then the helical groove of the cam sleeve applies pressure to the lug of the holder cup, which drives the holder cup up or down in the inner body, while the lugs ride in the longitudinal slot. In this way, the stick product is moved between an advanced position and a retracted position.

The holder cup is typically assembled into the top of the inner body. However, the lugs of the holder cup extend beyond the perimeter of the inner body, and the top of the inner body may not have enough stretch or flexibility to allow the lugs to pass through. In fact, to facilitate the insertion of the inner body into the cam sleeve, the top, outer edge of a conventional inner body is tapered, and this taper adds stiffness around the top perimeter of the inner body. Also, even if the lugs of the holder cup could be forced into the top of the inner body, both the inner body and lugs are likely to suffer some damage. To alleviate this problem, some inner bodies (50; see FIG. 14) are designed with a secondary slot (50*a*) that extends from the top of one of the longitudinal slots to open up onto the top edge of the inner body. This creates a break or gap in the top perimeter of the inner body. This gap adds some flexibility to the top portion of the inner body. Nevertheless, during the assembly of the holder cup and inner body, the top of the inner body needs to be held open with a tool so that the holder cup may be inserted into the inner body without scratching or otherwise damaging the top of the inner body or the lugs. However, even with this extra step of holding the top of the inner body opened, the holder cup must be inserted at an angle, so that one lug may be inserted before the other. This is a significant disadvantage in the assembly process. Sometimes, two secondary slots are used, so that the holder cup may be inserted upright into the inner body, but two gaps in the top perimeter of the inner body creates its own problems.

After the holder cup is inserted into the top of the inner body, the inner body and cam sleeve are assembled by inserting the top of the inner body into the bottom of the cam sleeve. As noted above, the secondary slot and the gap in the top perimeter of a conventional inner body allow the top portion of the inner body to flex. Also, the outer edge of the inner body is tapered. Both of these features facilitate the insertion of the inner body into the cam sleeve. However, before the top of the inner body can flex inwardly, the holder cup must be lowered to its retracted position. There are at least two disadvantages to this. First, it is just an extra step in the assembly process. Second, it would be advantageous for a product filler to receive the inner body-holder cup subassembly with the holder cup in its extended position, ready to fill. Otherwise, the filler must perform this step.

Even more serious problems caused by the gap in the top perimeter of the inner body concern performance and perception. The gap in the perimeter tends to loosen the assembly between the inner body and the holder cup. This creates a degree of wobbliness of the holder cup and stick product as the holder cup is being raised and lowered, and even when the holder cup is in its fully extended position. This wobbliness makes it difficult to control the application of product to the application surface, while also conveying a low quality image to the consumer. We also note that generally, the secondary slot and perimeter gap of a conventional inner body are visible to a consumer, and the non-symmetrical aesthetic impact is negative. Some efforts may be made to obscure the gap in the top perimeter of the inner body, but these are not wholly effective, and just add another step to the manufacturing and/or assembly processes.

Unrealized up to now are the advantages of an inner body with no secondary slot at the top end, there being no breaks or gaps in the perimeter of the top of the inner body. These advantages include: the top of the inner body does not need to be held open with a tool; the holder cup does not need to be retracted before assembling the inner body and cam sleeve; the holder cup does not need to be extended before product filling; a manufacturer can supply a product filler with inner body/holder cup subassemblies that are ready to fill; the wobbliness in operation is reduced; any unsightly appearance may be hidden from view.

OBJECT OF THE INVENTION

A main object of the present invention is to provide a container for a stick product that utilizes an inner body that has a continuous top perimeter, that is, one with no gaps in the top perimeter.

Another object of the invention is to provide improvements in methods of assembly of a container for a stick product.

SUMMARY

A container (10) for a stick product (7) according to the present invention comprises a cap (1), a base (2), an A-shell (3), a cam sleeve (4), an inner body (5) and a holder cup (6). The inner body is continuous along the top perimeter, which means that the longitudinal slots of the inner body do not open up onto the top perimeter of the inner body. Significant advantages in assembly are realized. Containers according to the present invention may be useful for all types of stick products that are applied to a surface by drawing the product across a surface. These include lipsticks, lip balms, deodorant sticks, anti-perspirant sticks, glue sticks, etc.

DETAILED DESCRIPTION OF THE INVENTION

Throughout the specification, the term "comprises" means that a collection of objects is not necessarily limited to those explicitly recited, but may or may not include additional objects.

For purposes of the present invention, a stick product is an elongated mass of solid or semi-solid product that is able to support its own weight when the elongated mass is suspended by one end.

Cap and Base

Figure 1:
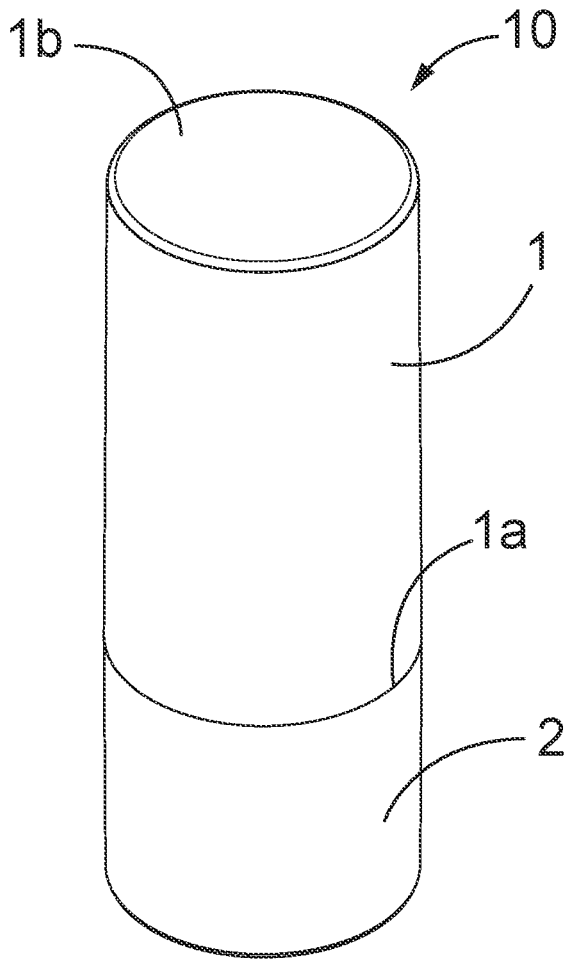
FIG. 1 is a perspective view of a cap and base for a container for a stick product according to the present invention.

FIG. 1 depicts a cap (1) and base (2) for a container (10) for a stick product (7) according to the present invention. The cap comprises an opened bottom (1*a*) that is designed to cooperate with the base, and a closed top (1*b*). The cap protects the contents of the container from the ambient environment, and is removably secured to the base by some means, such as an interference fit or snap fit.

Figure 2:
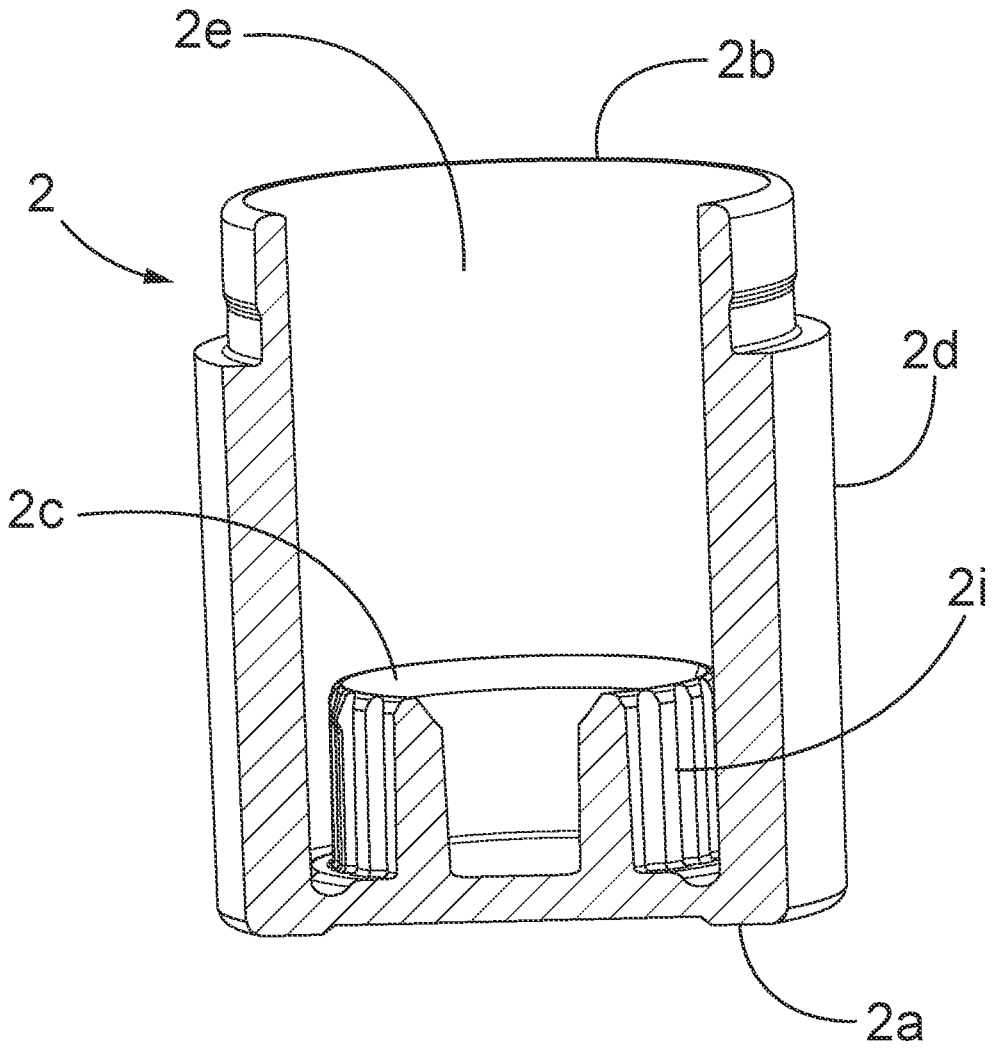
FIG. 2 is one embodiment of a base that may be useful in the present invention.

One embodiment of a base (2) is shown in FIG. 2. The base comprises a closed bottom (2*a*) and an opened top (2*b*) separated by a side wall (2*d*). The closed bottom and side wall define an interior space or an inside (2*e*) of the base. The base supports the A-shell (3) and inner body (5) by receiving the lower ends of each into the base, in a concentric arrangement. When assembled, the A-shell and base rotate independently. On the other hand, the base and inner body rotate as one. To accomplish this, the inside of the base may be provided with a first set of gear teeth (2*i*), that are located on a concentric ring (2*c*), that is supported on the closed bottom of the base.

A-Shell and Cam Sleeve

Figure 3:
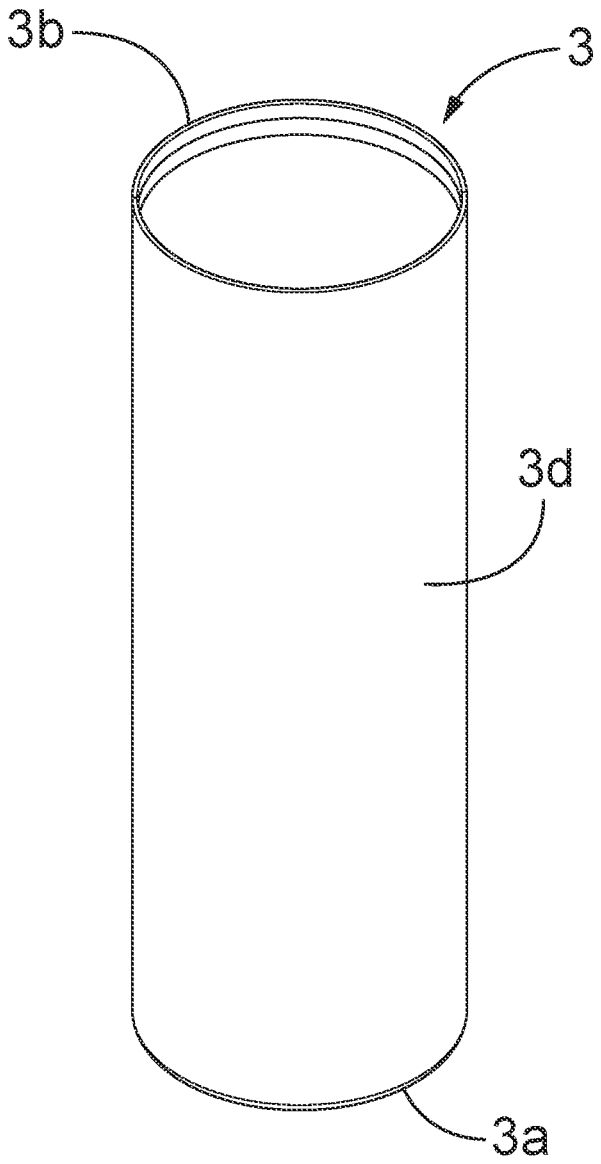
FIG. 3 depicts an A-shell for a container for a stick product according to the present invention.
Figure 4:
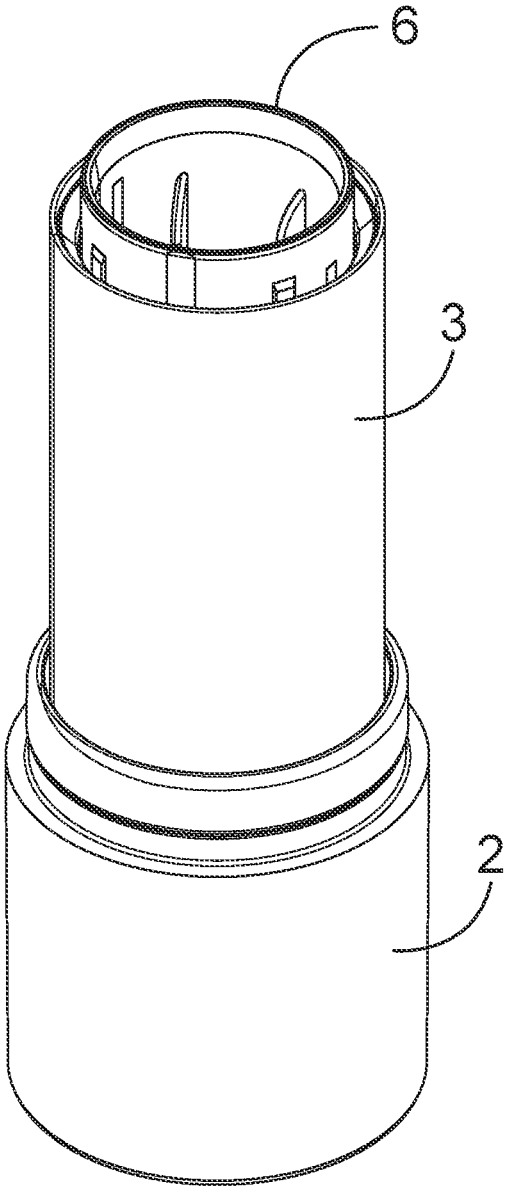
FIG. 4 depicts the A-shell sitting in the base with the holder cup at the advanced position.
Figure 5:
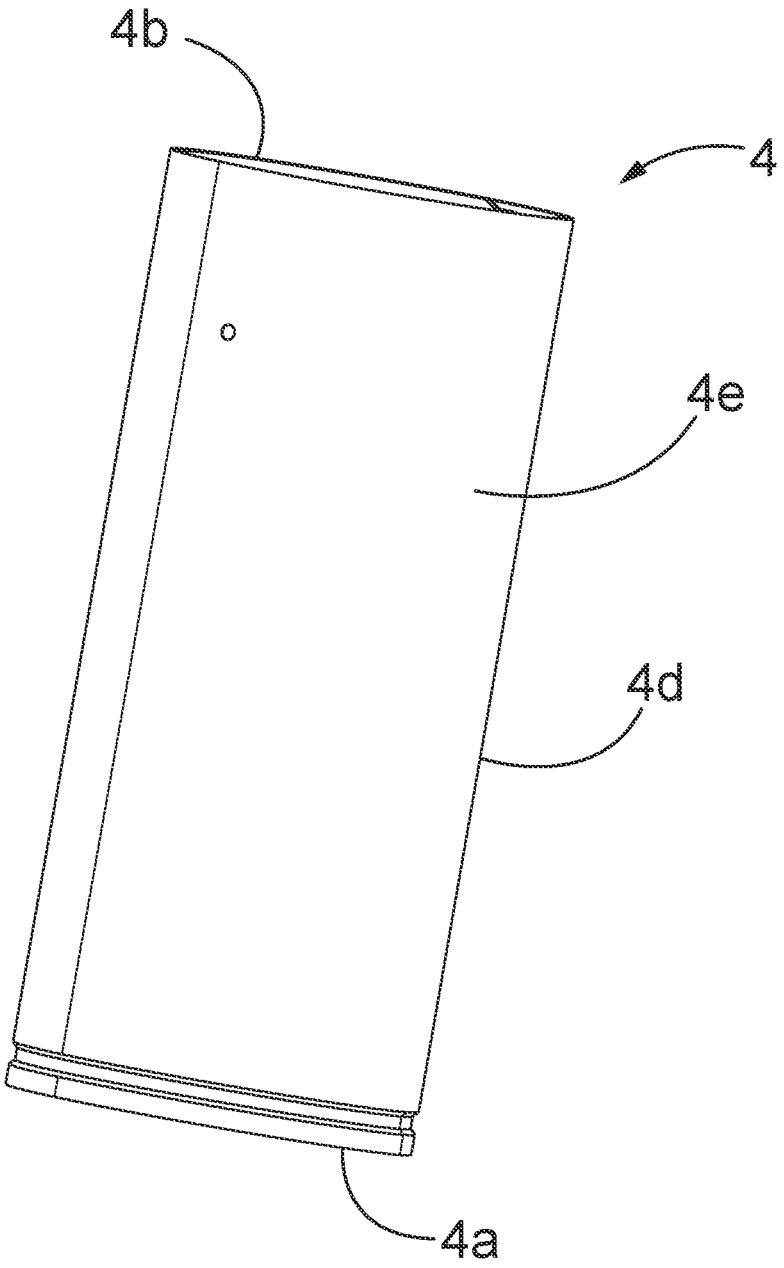
FIG. 5 depicts a cam sleeve for a container for a stick product according to the present invention.
Figure 6:
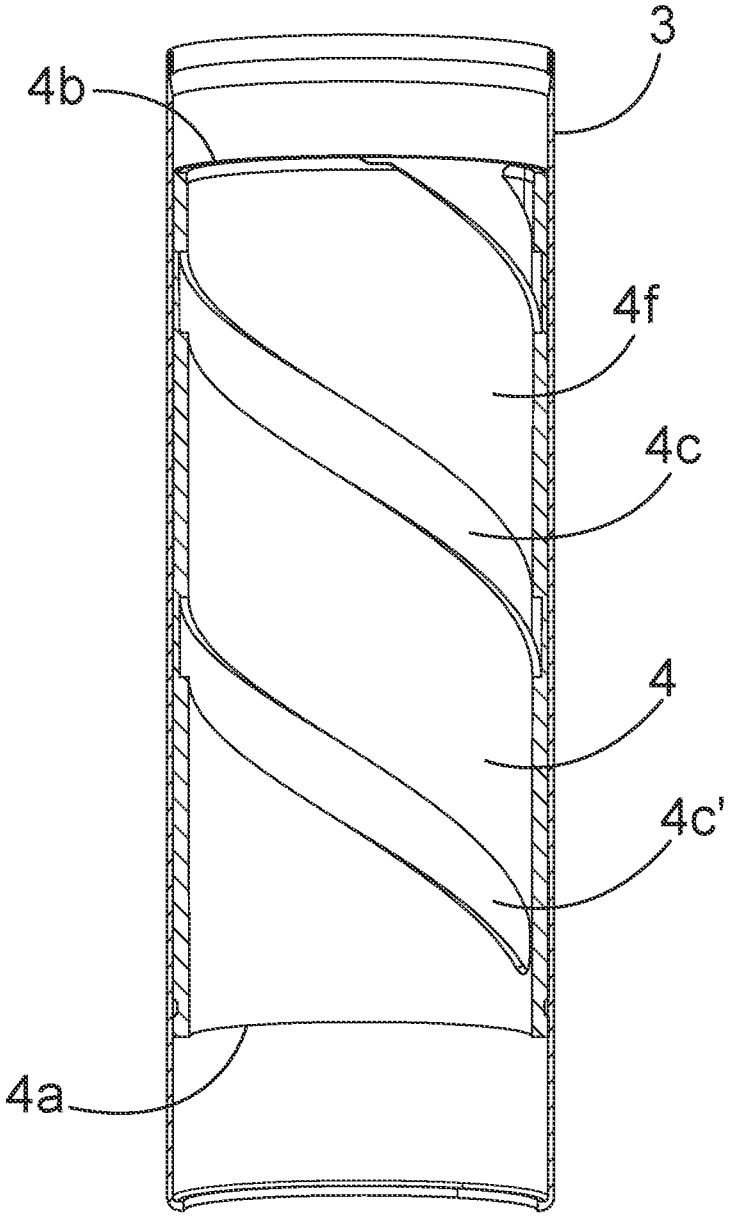
FIG. 6 is a cross sectional view of a cam sleeve positioned inside an A-shell.
Figure 7:
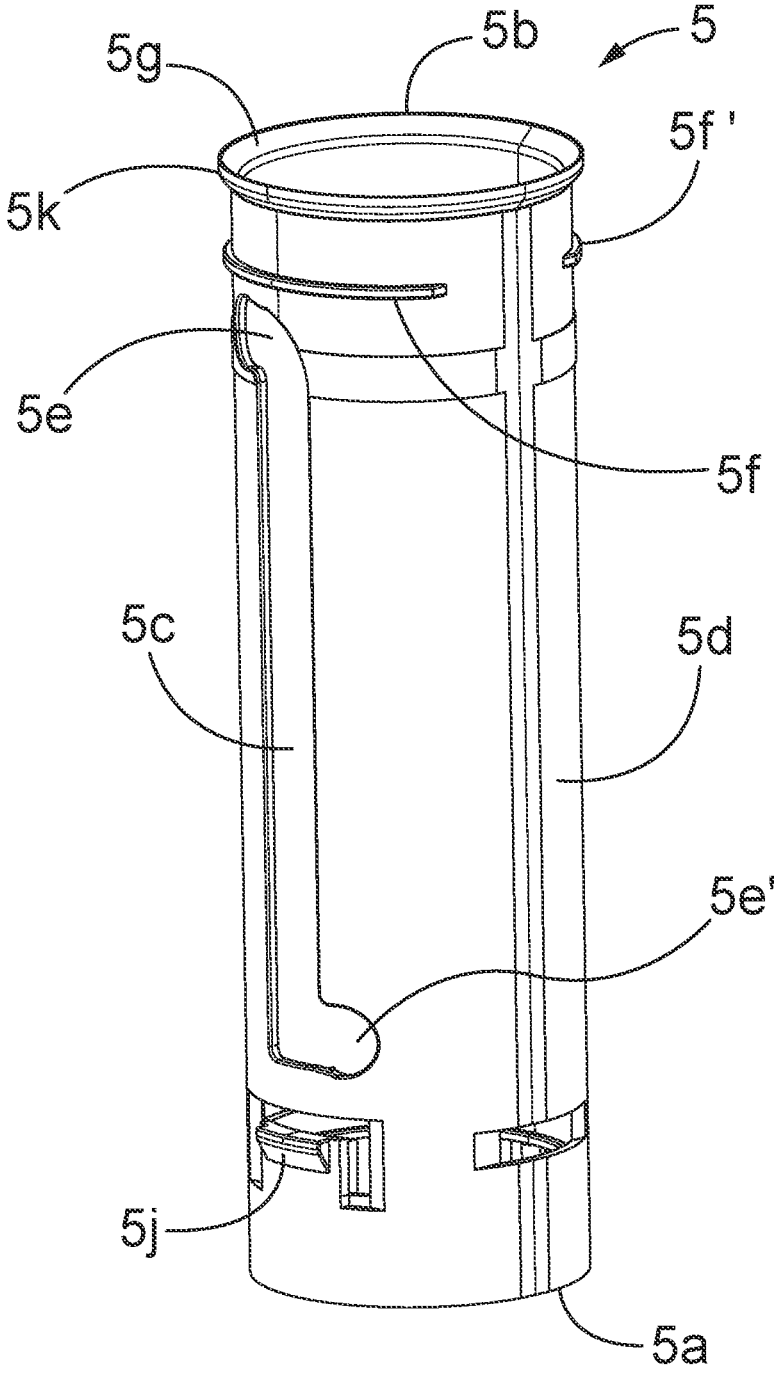
FIG. 7 depicts an inner body for a container for a stick product according to the present invention.
Figure 8:
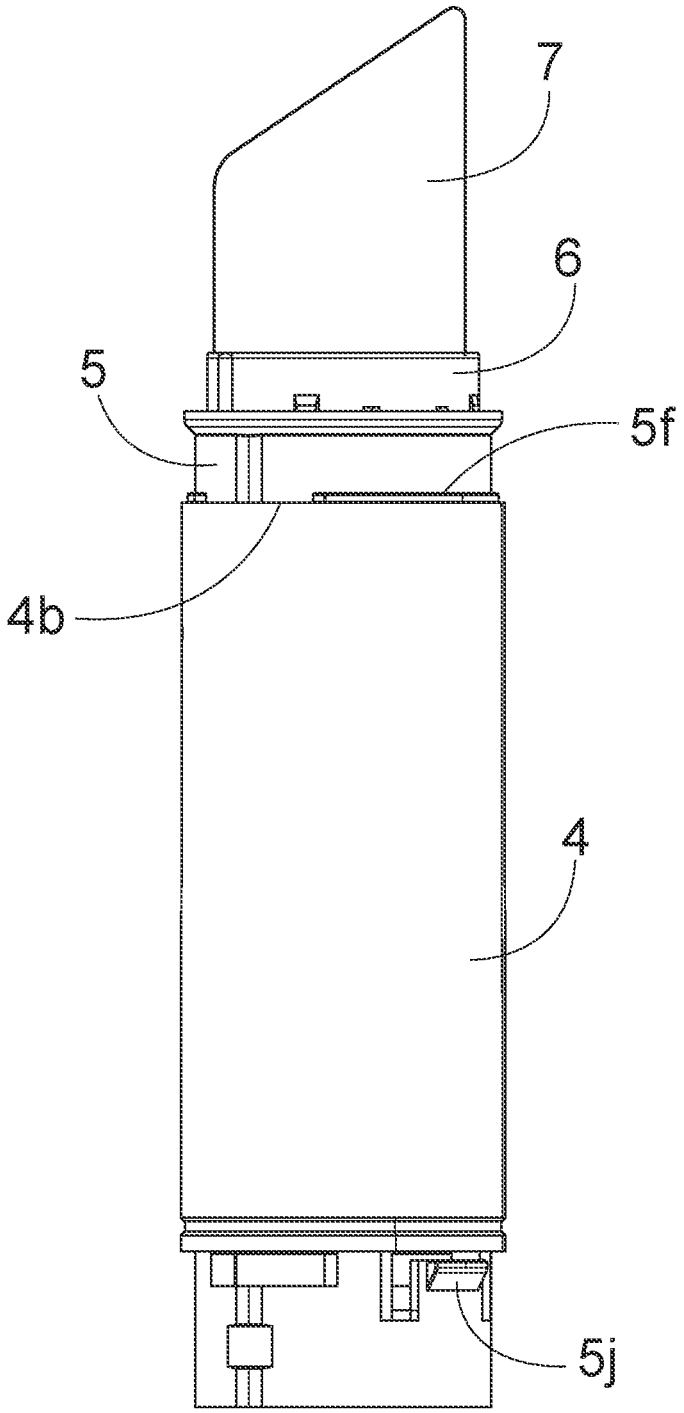
FIG. 8 depicts a holder cup partially inserted into the inner body which is inserted through the cam sleeve.
Figure 9:
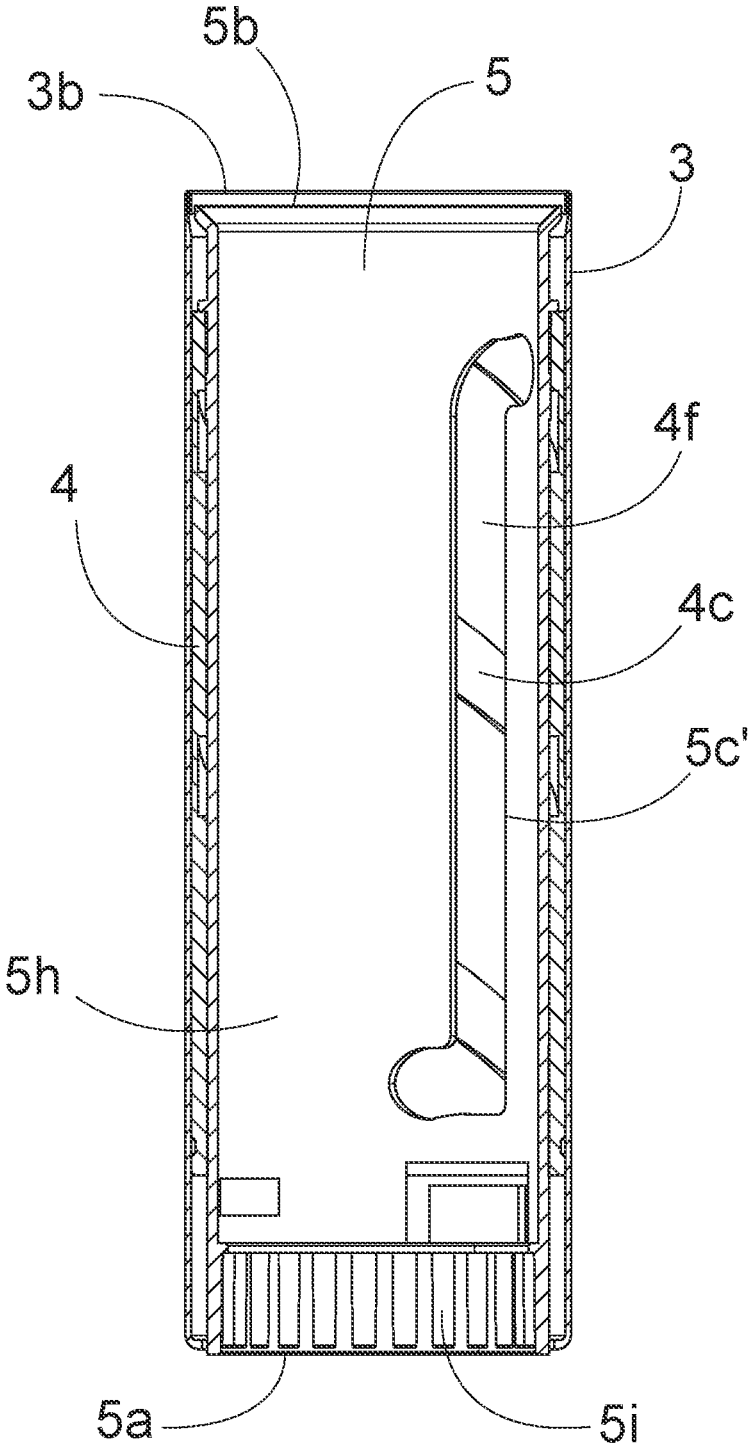
FIG. 9 is a cross sectional view of the A-shell, cam sleeve and inner body.
Figure 10:
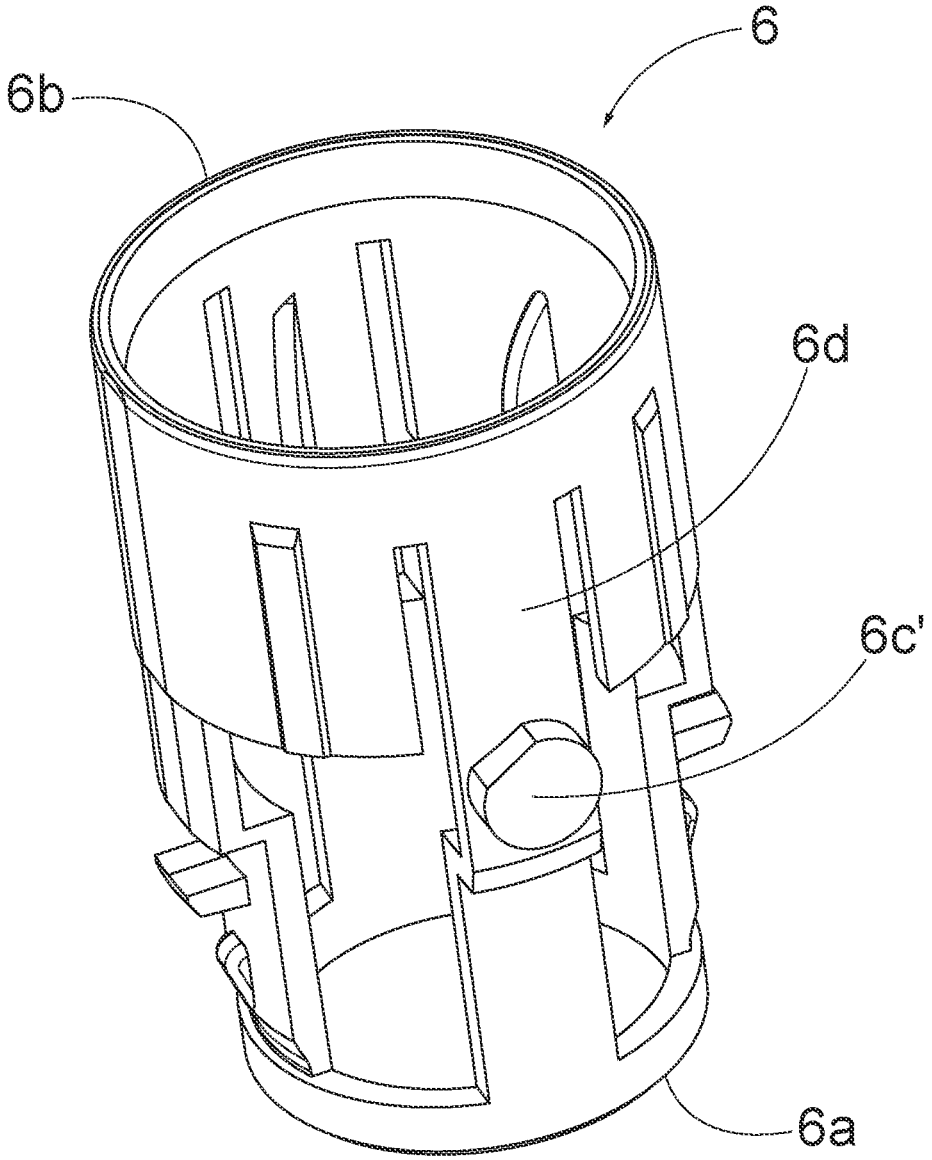
FIG. 10 is a perspective view of a holder cup.
Figure 11:
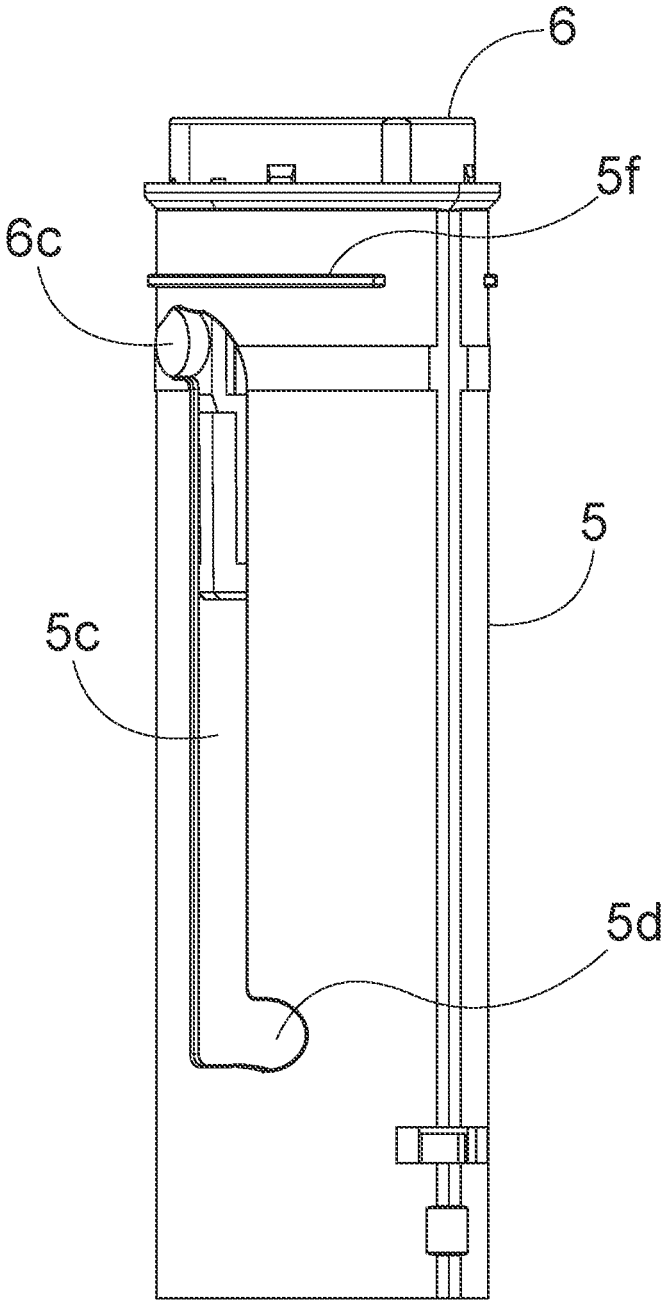
FIG. 11 depicts a holder cup partially inserted into the inner body.

Referring to FIGS. 3 and 4, the A-shell (3) is a cylindrical tube having an opened bottom (3*a*) and an opened top (3*b*) separated by a side wall (3*d*). The bottom of the A-shell rests inside the base (2), between the side wall (2*d*) and the concentric ring (2*c*). The cam sleeve (4) (see FIGS. 5, 6 and 9) comprises a generally cylindrical body that has an opened top (4*b*) and an opened bottom (4*a*) separated by a side wall (4*d*). The cam sleeve is shorter than the A-shell. The entire length of the cam sleeve is positioned inside the A-shell so that none of the cam sleeve protrudes from the A-shell. There is a very close fit between the side wall (4*d*) of the cam sleeve and the side wall (3*d*) of the A-shell, and some means is used to ensure that the A-shell and cam sleeve rotate as one. For example, during assembly, a fixture on the assembly line is used to set the cam sleeve at a pre-determined position or height inside the A-shell. The cam sleeve will be secured to the A-shell, normally being glued together or crimped with dot on the outside of the A-shell.

The side wall (4*d*) of the cam sleeve (4) is generally solid and has an outer surface (4*e*) and an inner surface (4*f*). The inner surface is provided with at least one helical groove, preferably with two helical grooves (4*c*, 4*c*'). The helical grooves start at the top (4*b*) of the cam sleeve and complete some number revolutions or fractions thereof, to end near the bottom (4*a*) of the cam sleeve. Also, the cam sleeve is able to receive the inner body (5) into itself, in a concentric fashion. When positioned around the inner body, the cam sleeve and inner body are able to rotate independently of each other.

Inner Body and Holder Cup

Referring to FIGS. 7-9 and 11-13, an inner body (5) according to the present invention is generally cylindrical, and comprises an opened top (5*b*) and an opened bottom (5*a*) separated by a side wall (5*d*). During assembly, the bottom of the inner body is inserted into the top (4*b*) of the cam sleeve (4). In the final assembly, the inner body protrudes from both ends of the cam sleeve, and is rotatable with respect to the cam sleeve. A second set of gear teeth (5*i*) are located near the bottom of the inner surface (5*h*) of the side wall. The bottom of the inner body is designed to be received into the base (2), such that the first set of gear teeth (2*i*) mesh with the second set of gear teeth (5*i*). Once assembled, the base and inner body will rotate as one. The order of assembly is important, as will be explained below.

A least one, preferably two longitudinal slots (5*c*, 5*c*'), 180° apart, pass through the side wall (5*d*) of the inner body (5). The upper and lower ends of the longitudinal slots may be formed as horizontal slot extensions (5*e*, 5*e*'). By design, neither the longitudinal nor the horizontal slots open up onto the top (5*b*) of the inner body, as is typically done. That is to say, there is no secondary slot, as discussed above. In fact, the perimeter of the top (5*b*) of the inner body is continuous or unbroken; this is critical. Also, the top of the inner body is formed to overhang (5*k*) the side wall (5*d*). During assembly, the inner body may be inserted into the cam sleeve (4) by pushing down on the overhang. The overhang has an inwardly beveled surface (5*g*) that slopes toward the interior of the inner body. This is different from the outwardly beveled surface commonly seen.

Above the level of the at least one longitudinal slot (5*c*, 5*c*') of the inner body (5), at least one horizontal bead, preferably two horizontal beads (5*f*, 5*f*) extend along the side wall (5*d*). The diameter of the inner body at the level of the horizontal beads is slight greater than the diameter at the top (4*b*) of the cam sleeve (4), but less than the inner diameter of the A-shell (3). Therefore, as the bottom of the inner body is inserted into the top of the cam sleeve, the horizontal beads come to contact the top of the cam sleeve, which act as a stop to prevent further insertion of the inner body (see FIG. 8), at which point the inner body is fully inserted into the cam sleeve.

Once the inner body is fully inserted into cam sleeve, it must be prevented from backing out. For example, when the base (2) is inserted into the bottom (5*a*) of the inner body, there will be some resistance which might dislodge the inner body with respect to the cam sleeve (4). To prevent this, a flexible tab (5*j*) is located in the side wall (5*d*), just below at least one of the longitudinal slots (5*c*, 5*c*'). The flexible tab is connected to the side wall of the inner body by a living hinge that biases the tab to protrude outward from the side wall. The flexible tab comprises a beveled side surface and a horizontal top surface. When the beveled surface of the tab hits the top (4*b*) of the cam sleeve, the tab flexes inwardly to allow the inner body to be inserted. But once the tab emerges from the bottom (4*a*) of the cam sleeve, the tab returns to its extended position, and the horizontal surface of the tab prevents upward movement of the inner body with respect to the cam sleeve. In the fully assembled container (10), the inner body protrudes from both ends of the cam sleeve, however, the top (5*b*) of the inner body does not protrude beyond the top (3*b*) of the A-shell (3).

Referring to FIGS. 8 and 10-12, the holder cup (6) comprises a bottom (6*a*) that may be opened or closed, and an opened top (6*b*). The top and bottom are separated by a side wall (6*d*). The holder cup is able to receive and retain a stick product (7) which may be inserted into the holder cup through the opened top. At least one lug, preferably two lugs (6*c*, 6*c*') are located 180° apart to align with the longitudinal slots (5*c*, 5*c*') of the inner body (5). Optionally, the lugs may be located on a flexible section of the side wall. For example, in FIG. 10, the lugs sit on a thin strip of side wall, so that inwardly directed pressure on the lugs would cause the lugs to pinch inward. Once the pressure is relieved, the lugs would return to their original position. This facilitates the assembly of the holder cup into the inner body. For example, as the bottom (6*a*) of holder cup is inserted through the top (5*b*) of the inner body, the lugs will contact the beveled surface (5*g*) of the overhang (5*k*) which causes the lugs to pinch inward. As the holder cup reaches a defined depth inside the inner body, the lugs of holder cup will enter the horizontal slots (5*e*, 5*e*') of the inner body, and return to there original position.

Figure 12:
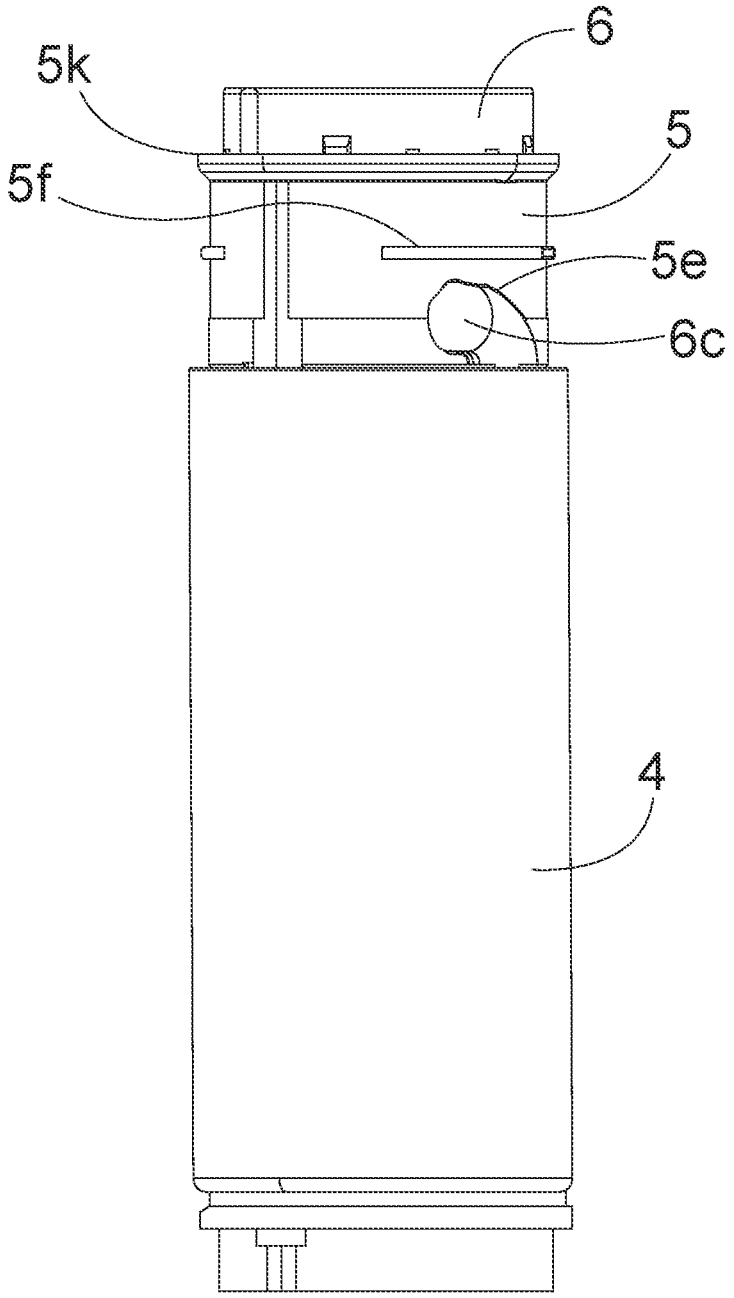
FIG. 12 depicts the inner body and cam sleeve in a partially assembled configuration.
Figure 13:
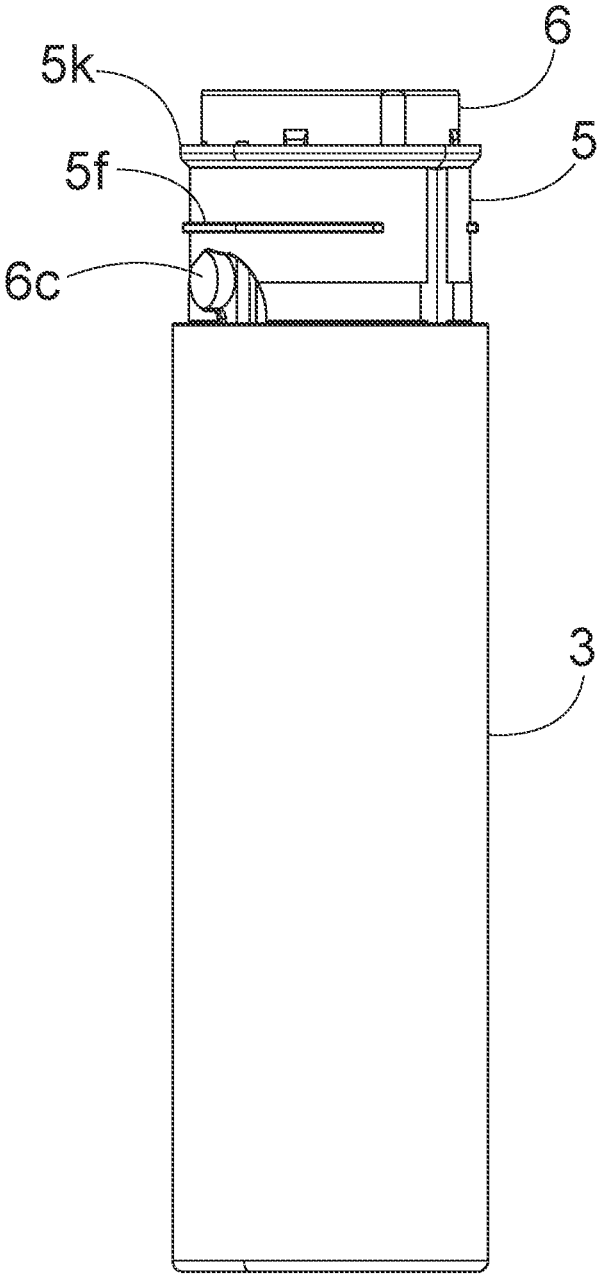
FIG. 13 shows the inner body sitting above the A-shell when the inner body and cam sleeve are in the partially assembled configuration shown in FIG. 12.
Figure 14:
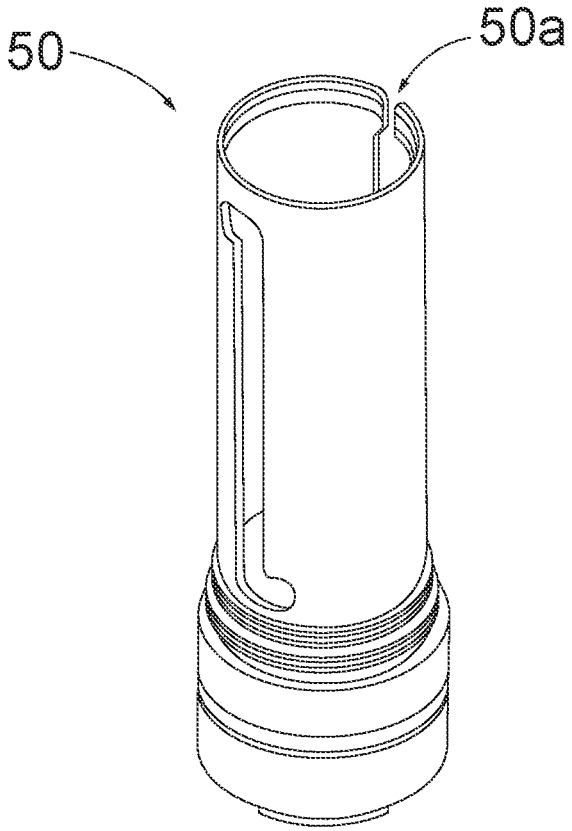
FIG. 14 (PRIOR ART)
FIG. 14 depicts a conventional inner body with one secondary slot that opens up onto the top edge of the inner body.

Alternatively, the plastic material at the top of the inner body (5) may be sufficiently flexible to allow the lugs (6*c*, 6*c*') of the holder cup (6) to be forced through the top (5*b*) of the inner body, and into the longitudinal slots (5*c*, 5*c*'). Depending on the order of assembly, it is sometimes preferable that the inner body and cam sleeve (4) are capable of maintaining a partially assembled configuration prior to the insertion of the holder cup. Referring to FIG. 12, in this partially assembled configuration, the horizontal beads (5*f*, 5*f*) of the inner body are not yet contacting the top (4*b*) of the cam sleeve, and the horizontal slot extensions (5*e*, 5*e*') are not covered by the cam sleeve. Also, if the A-shell is present at this step of assembly, then the top (5*b*) of the inner body would be sitting above the top (3*b*) of the A-shell (3) (see FIG. 13). The flexible tab (5*j*) of the inner body exerts an outward pressure against the inner surface (4*f*) of the cam sleeve. Preferably, that pressure is sufficient to maintain the inner body and cam sleeve in this partially assembled configuration. The purpose of this configuration is to aid the assembly of the holder cup (6) into the top (5*b*) of the inner body without interference from the cam sleeve or A-shell. As the holder cup (with or without a stick product 7) is inserted through the top of the inner body, the lugs of the holder cup are made to sit in the longitudinal slots. At this point, by pushing down on the overhang (5*k*) at the top (5*b*) of the inner body, and simultaneously rotating the inner body with respect to the cam sleeve, the inner body may be further inserted into the cam sleeve until the horizontal beads (5*f*, 5*f*) of the inner body contact the top (4*b*) of the cam sleeve, and the lugs of the holder cup enter the two helical grooves (4*c*, 4*c*') of the cam sleeve. If the cam sleeve has not already been inserted into the A-shell, then that may be done now by pushing down on the overhang (5*k*) at the top (5*b*) of the inner body to drive the cam sleeve to its pre-determined height within the A-shell, where the cam sleeve and A-shell may be glued together or crimped with dot on the outside of the A-shell. If the inner body is scratched or incurs any damage by forcing the holder cup (6) through the top (5*b*) of the inner body (5), it will not be visible in the fully assembled container (10), because the top (5*b*) of the inner body sits below the top (3*b*) of the A-shell.

Several methods of assembly are possible, each with advantages. Examples of some of the preferred methods are described here.

Example 1—Method of Assembly

1. Assemble the cam sleeve (4) at a predetermined height within the A-shell (3).
2. Partially insert the bottom (5*a*) of the inner body (5) into the cam sleeve so that the flexible tab (5*j*) of the inner body exerts an outward pressure against the inner surface (4*f*) of the cam sleeve, and the horizontal slot extensions (5*e*, 5*e*') of the inner body remain exposed above the cam sleeve.
3. Assemble the holder cup (6) into the top (5*b*) of the inner body (5) such that the holder cup sits in an extended position, protruding from the top of the inner body, with the lugs (6*c*, 6*c*') of the holder cup sitting in the horizontal slot extension (5*e*, 5*e*') of the inner body.
4. Fully inserting the inner body into the cam sleeve by pushing down on the overhang (5*k*) of the inner body and simultaneously rotating the inner body until the horizontal beads (5*f*, 5*f*) of the inner body contact the top (4*b*) of the cam sleeve, at which point the flexible tab of the inner body extends outward below the bottom (4*a*) of the cam sleeve, the lugs of the holder cup enter the two helical grooves (4*c*, 4*c*') of the cam sleeve, and the top (5*b*) of the inner body is below the top (3*b*) of the A-shell (3).
5. Insert the bottom (3*a*) of the A-shell and the bottom (5*a*) of the inner body into the base (2) such that the second set of gears (5*i*) of the inner body (5) are meshed with the first set of gears (2*i*) of the base (2).
6. Optionally, rotate the base with respect to the A-shell to lower the holder cup to its retracted position.
7. Optionally, a cap (1) is fitted onto the base to complete the container (10).

Variations of this method include the step of inserting a stick product (7) into the holder cup, this step occurring before step 3, or between steps 3 and 4, or between steps 4 and 5, or between steps 5 and 6.

Example 2—Method of Assembly

1. Assemble the cam sleeve (4) at a predetermined height within the A-shell (3).
2. Assemble the inner body (5) and holder cup (6) such that the holder cup sits in its extended position, protruding from the top (5*b*) of the inner body, with the lugs (6*c*, 6*c*') sitting in the horizontal slot extension (5*e*, 5*e*').
3. Insert the bottom (5*a*) of the inner body into the top (4*b*) of the cam sleeve, and push down on the overhang (5*k*) of the inner body and simultaneously rotating the inner body until the horizontal beads (5*f*, 5*f*) of the inner body contact the top (4*b*) of the cam sleeve, and the flexible tab (5*j*) of the inner body extends outward below the bottom (4*a*) of the cam sleeve, while the lugs of the holder cup enter the two helical grooves (4*c*, 4*c*') of the cam sleeve. At that point, the top (5*b*) of the inner body is below the top (3*b*) of the A-shell (3).

4. Insert the bottom (3*a*) of the A-shell and the bottom (5*a*) of the inner body into the base (2) such that the second set of gears (5*i*) of the inner body (5) are meshed with the first set of gears (2*i*) of the base (2).

5. Optionally, rotate the base with respect to the A-shell to lower the holder cup to its retracted position.

6. Optionally, a cap (1) is fitted onto the base to complete the container (10).

Variations of this method include the step of inserting a stick product (7) into the holder cup, this step occurring before step 1, or between steps 1 and 2, or between steps 2 and 3, or between steps 3 and 4, or between steps 4 and 5.

Example 3—Method of Assembly

1. Partially insert the bottom (5*a*) of the inner body (5) into the cam sleeve (4) so that the flexible tab (5*j*) of the inner body exerts an outward pressure against the inner surface (4*f*) of the cam sleeve, and the horizontal slot extensions (5*e*, 5*e*') of the inner body remain exposed above the cam sleeve.

2. Insert the holder cup (6) into the top (5*b*) of the inner body, so that the holder cup sits in its extended position, protruding from the top (5*b*) of the inner body, with the lugs (6*c*, 6*c*') sitting in the horizontal slot extensions (5*e*, 5*e*').

3. Fully inserting the inner body into the cam sleeve by pushing down on the overhang of the inner body and simultaneously rotating the inner body until the horizontal beads (5*f*, 5*f*) of the inner body contact the top (4*b*) of the cam sleeve, and the flexible tab (5*j*) of the inner body extends outward below the bottom (4*a*) of the cam sleeve, while the lugs (6*c*, 6*c*') of the holder cup (6) enter the two helical grooves (4*c*, 4*c*') of the cam sleeve.

4. Insert the cam sleeve (4) into the A-shell (3) to a pre-determined height such that the top (5*b*) of the inner body is below the top (3*b*) of the A-shell (3).

5. Insert the bottom (3*a*) of the A-shell and the bottom (5*a*) of the inner body into the base (2) such that the second set of gears (5*i*) of the inner body (5) are meshed with the first set of gears (2*i*) of the base (2).

6. Optionally, rotate the base with respect to the A-shell to lower the holder cup to its retracted position.

7. Optionally, a cap (1) is fitted onto the base to complete the container (10).

Variations of this method include the step of inserting a stick product (7) into the holder cup, this step occurring before step 1, or between steps 1 and 2 or between steps 2 and 3 or between steps 3 and 4 or between steps 4 and 5, or between steps 5 and 6.

A container for a stick product according to the present invention, which utilizes an inner body having no gaps in the perimeter at the top of the inner body, offers a number of advantages over conventional designs. For example, during the pre-assembly of the holder cup and inner body, the top of the inner body does not need to be "opened" with a tool, which makes the assembly process more efficient; the holder cup does not need to be retracted before assembling the inner body and cam sleeve; the holder cup may not need to be extended before product filling; a manufacturer can supply a product filler with inner body/holder cup subassemblies that are ready to fill. A container according to the present invention is more stable, since there is no or reduced wobbliness of the holder cup and stick product. Overall, the present design has an improved appearance, as there are no visible gaps or scratches.

What is claimed is:

1. A container (10) for a stick product (7) that comprises:

a base (2) that comprises:
- an interior space (2*e*); and
- a first set of gear teeth (2*i*) located in the interior space;

a cylindrical A-shell (3) that comprises:
- an opened bottom (3*a*) that rests in the interior space (2*e*) of the base (2);
- an opened top (3*b*); and
- a side wall (3*d*)

a cylindrical cam sleeve (4) that comprises:
- an opened bottom (4*a*);
- an opened top (4*b*); and
- a side wall (4*d*) that has at least one helical groove (4*c*) on an inner surface (4*f*) of the side wall;
- wherein the cam sleeve is positioned entirely inside the A-shell and the A-shell and cam sleeve are able to rotate as one;

a cylindrical inner body (5) inserted into the cam sleeve (4) and comprising:
- an opened bottom (5*a*);
- an opened top (5*b*) that has:
  - a continuous perimeter with no gaps; and
  - an overhang (5*h*) with an inwardly beveled surface (5*g*);
- a side wall (5*d*) that has:
  - at least one longitudinal slot (5*c*) that passes therethrough;
  - at least one horizontal bead (5*f*) that extends along the side wall of the inner body, above the at least one longitudinal slot, and rests on the top of the cam sleeve;
  - a flexible tab (5*j*) located below one of the longitudinal slots, such that the flexible tab is biased to protrude outward from the side wall of the inner body, and lies below the bottom (4*a*) of the cam sleeve (4); and
  - a second set of gear teeth (5*i*) located near the bottom of an inner surface (5*h*) of the side wall of the inner body;
- wherein the inner body protrudes from both ends of the cam sleeve, and is rotatable with respect to the cam sleeve; and
- the bottom of the inner body is received into the interior space (2*e*) of the base (2), such that the first set of gear teeth (2*i*) mesh with the second set of gear teeth (5*i*); and a holder cup (6) that is able to receive and retain a stick product (7), the holder cup being located in the inner body, and having at least one lug (6*c*) that extend through the at least one longitudinal slot (5*c*) of the inner body (5) and into the at least one helical groove (4*c*) of the cam sleeve (4).

2. A container (10) for a stick product (7) according to claim 1 wherein:
- the at least one helical groove is two helical grooves (4*c*, 4*c*');
- the at least one longitudinal slot (5*c*) is two longitudinal slots (5*c*, 5*c*');
- the at least one horizontal bead (5*f*) is two horizontal beads (5*f*, 5*f*'); and
- the at least one lug (6*c*) is two lugs (6*c*, 6*c*').

3. A container (10) for a stick product (7) according to claim 1 wherein the at least one lug (6*c*) is located on a flexible section of a side wall (6*d*) of the holder cup (6) that allows the lug to pinch inward as it passes over the beveled surface (5*g*) of the overhang (5*k*).

4. A method of assembling a container (10) according to claim 1 comprising the steps of:

a. partially inserting the inner body (5) into the cam sleeve (4) so that the flexible tab (5*j*) of the inner body exerts an outward pressure against the inner surface (4*f*) of the cam sleeve, and the horizontal slot extensions (5*e*, 5*e*') remain exposed above the cam sleeve; then b. assembling the holder cup (6) into the top (5*b*) of the inner body (5) such that the holder cup sits in an extended position, protruding from the top of the inner body, with the lugs (6*c*, 6*c*') of the holder cup sitting in the horizontal slot extension (5*e*, 5*e*') of the inner body, and then c. fully inserting the inner body into the cam sleeve by pushing down on the overhang (5*k*) of the inner body until the horizontal beads (5*f*, 5*f*') of the inner body contact the top (4*b*) of the cam sleeve, at which point the flexible tab of the inner body extends outward below the bottom (4*a*) of the cam sleeve, and the lugs of the holder cup enter the two helical grooves (4*c*, 4*c*') of the cam sleeve.

5. The method of claim 4 further comprising the step of assembling the cam sleeve (4) at a predetermined height within the A-shell (3), which step may occur before the step of partially inserting the inner body (5), or immediately after the step of fully inserting the inner body.

6. The method of claim 5 further comprising the step of inserting the bottom (3*a*) of the A-shell (3) and the bottom (5*a*) of the inner body (5) into the base (2) such that the second set of gears (5*i*) of the inner body (5) are meshed with the first set of gears (2*i*) of the base (2).

7. The method of claim 6 further comprising the step of inserting a stick product (7) into the holder cup (6).

8. A method of assembling a container (10) according to claim 1 comprising the steps of:

a. assembling the cam sleeve (4) at a predetermined height within the A-shell (3);

b. assembling the inner body (5) and holder cup (6) such that the holder cup sits in its extended position, protruding from the top (5*b*) of the inner body, with the lugs (6*c*, 6*c*') sitting in the horizontal slot extension (5*e*, 5*e*');

c. inserting the bottom (5*a*) of the inner body into the top (4*b*) of the cam sleeve until the horizontal beads (5*f*, 5*f*') of the inner body contact the top (4*b*) of the cam sleeve, so that the flexible tab (5*j*) of the inner body extends outward below the bottom (4*a*) of the cam sleeve, the lugs of the holder cup enter the two helical grooves (4*c*, 4*c*') of the cam sleeve, and the top (5*b*) of the inner body is below the top (3*b*) of the A-shell (3);

d. inserting the bottom (3*a*) of the A-shell and the bottom (5*a*) of the inner body into the base (2) such that the second set of gears (5*i*) of the inner body (5) are meshed with the first set of gears (2*i*) of the base (2);

e. optionally, rotating the base with respect to the A-shell to lower the holder cup to its retracted position;

f. optionally, fitting a cap (1) is onto the base to complete the container (10).

9. The method of claim 8 further comprising the step of inserting a stick product (7) into the holder cup (6).

* * * * *